United States Patent [19]

Resta et al.

[11] Patent Number: 4,858,540

[45] Date of Patent: Aug. 22, 1989

[54] QUILTING MACHINE WITH ADJUSTABLE-LENGTH CLOTH-HOLDER CYLINDER

[75] Inventors: Rodolfo Resta; Mario Resta; Roberto Resta, all of Faenza, Italy

[73] Assignee: Resta Commerciale S.r.l., Faenza, Italy

[21] Appl. No.: 142,113

[22] Filed: Jan. 7, 1988

[51] Int. Cl.[4] ..... D05B 11/00

[52] U.S. Cl. ..... 112/117; 112/119

[58] Field of Search ..... 112/118, 117, 119

[56] References Cited

U.S. PATENT DOCUMENTS

| | | | |
|---|---|---|---|
| 448,253 | 3/1891 | Palmer | 112/119 |
| 1,937,491 | 11/1933 | May | 112/117 |
| 2,377,951 | 6/1945 | May | 112/118 |
| 2,490,887 | 12/1949 | Schadt | 112/118 |
| 4,716,845 | 1/1988 | Condos | 112/118 |

*Primary Examiner*—Ronald Feldbaum

*Attorney, Agent, or Firm*—Guido Modiano; Albert Josif

[57] ABSTRACT

The quilting machine includes a cloth-holder cylinder supported rotatable about a horizontal axis and provided with means for fastening the cloth along a cylindrical path. Externally to the cloth, along a generatrix of the cylinder, there moves a sewing head the motion whereof is coordinated with that of the cylinder so that the sewing line follows a predetermined trajectory.

6 Claims, 5 Drawing Sheets

4
131
132
135
136
137
9
8
130
6
129
28
27
96
95
93
88
89
92
65
87
113
100
138
84
115
24
104
126
25
21
136
20
10
135
11
110
112
109
85
118
120
19
16
124
101
105
122
17
12
18
98
13
99
97
57
53
52
55
106
22
107
58
103
15
102
23
26
61

4
8
9
31
29
30
114
116
38
127
11
41
10
39
44
117
120
45
36
46
47
109
112
119
121
125
33
32
111
123
49
48
43
42
14
12
59
54
52
56
60
62
40
37
15

QUILTING MACHINE WITH ADJUSTABLE-LENGTH CLOTH-HOLDER CYLINDER

BACKGROUND OF THE INVENTION

The present invention relates to a quilting machine with adjustable-length cloth-holder cylinder.

Currently various types of quilting machines, used for the quilting of quilted blankets, eiderdowns, mattresses and the like, are available on the market. In a first type of quilting machine, the cloth to be quilted is stretched and fixed on a first carriage, which slides linearly on a second carriage.

The second carriage also slides in a direction at right angle relatively to that of the first carriage. The carriages are controlled so as to move below a fixed sewing head according to a trajectory imparted by a template or by another control system.

Another type of quilting machine operates exactly in reverse; in fact, it is the sewing head which moves along orthogonal axes with respect to a stationary carriage whereon the cloth to be quilted is fixed.

This known quilting machines have markedly excessive planar dimensions. Furthermore, the movement of the carriages, due to the considerable inertia masses involved, imposes operational limitations.

SUMMARY OF THE INVENTION

The technical aim of the present invention is therefore to provide a quilting machine which allows to obviate the disadvantages of known ones, in particular considerably reducing the dimensions and having a high flexibility in use in terms of the possibility of operating on products with different dimensions and thicknesses.

This aim is achieved by a quilting machine, characterized in that it comprises a cloth-holder cylinder supported rotatable about a horizontal axis and provided with means for fastening a cloth along a cylindrical path, a sewing head supported externally to said cloth and slideable parallel to the cylinder, means for the movement of said sewing head and of said cylinder being furthermore provided to impart a predetermined trajectory to the sewing line.

BRIEF DESCRIPTION OF THE DRAWINGS

Further characteristics of the invention will become apparent from the following description of an embodiment illustrated only by way of non-limitative example in the accompanying drawings, wherein.

DESCRIPTION OF THE PREFERRED EMBODIMENT

Figure 1:
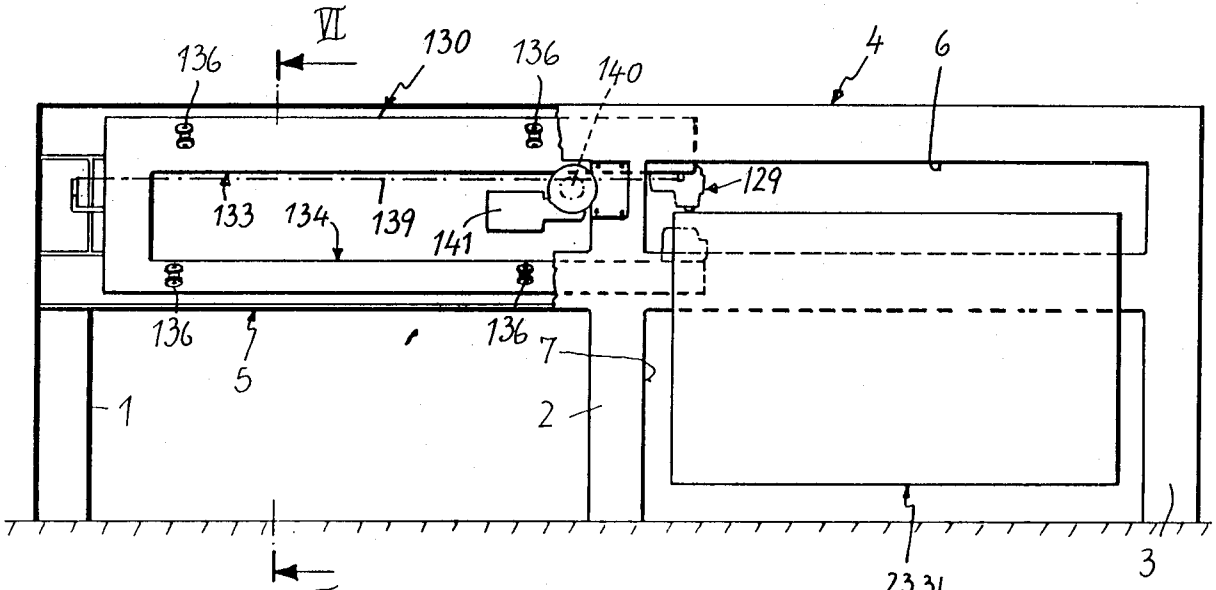
FIG. 1 is a partially schematic elevation view of the machine.
Figure 6:
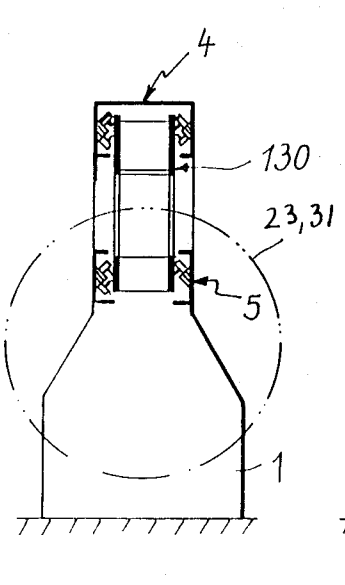
FIG. 6 is a view along the sectional plane VI—VI of FIG. 1.

With reference to the above described figures, the machine comprises a frame composed of three columns 1, 2 and 3 which rest on the ground and are mutually connected by an upper beam 4 and by an intermediate beam 5, both horizontal. Two superimposed openings 6, 7 are defined between the beams 4 and 5 and the columns 2 and 3.

Figure 2:
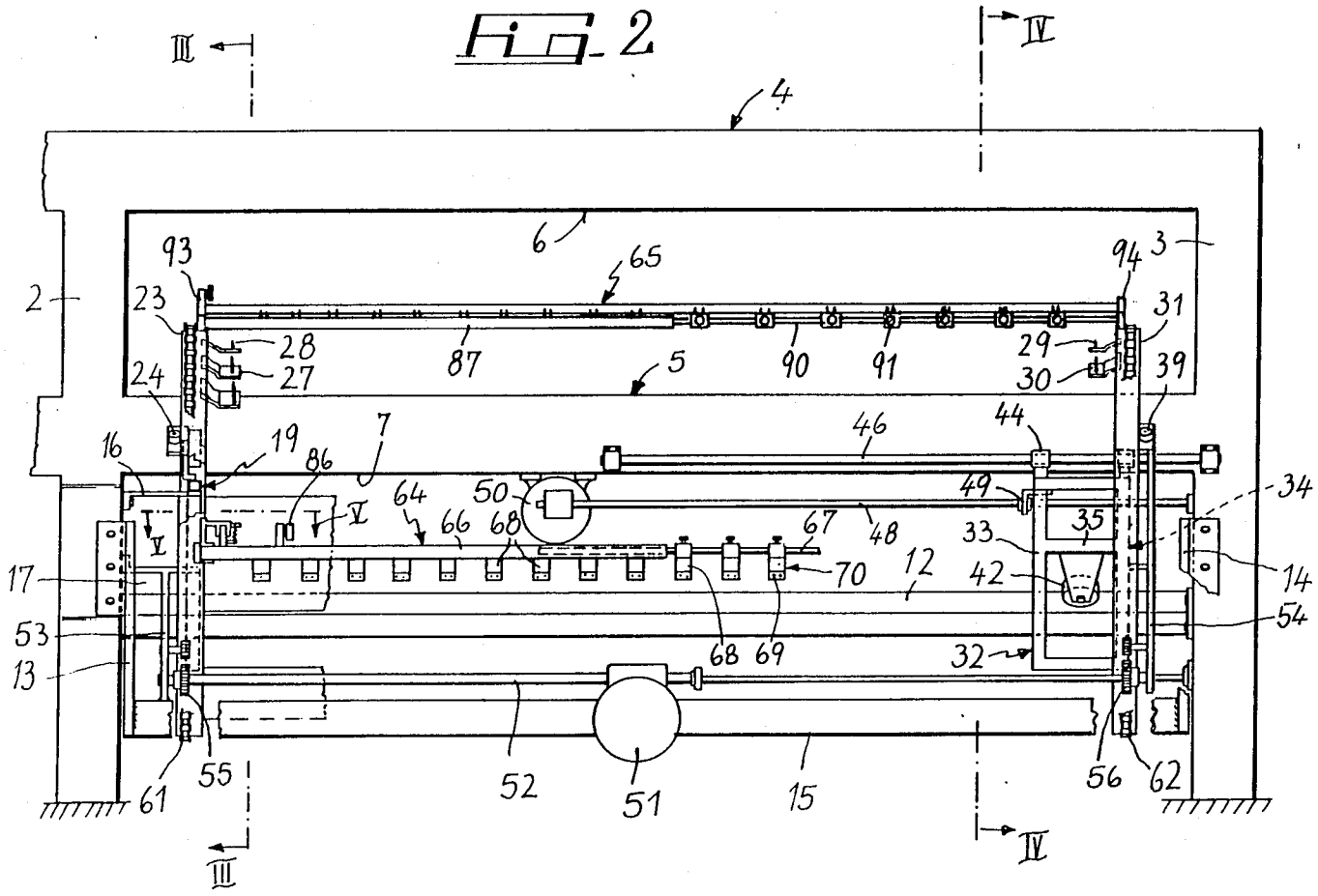
FIG. 2 is an elevation view of the part related to the cloth-holder cylinder.
Figure 3:
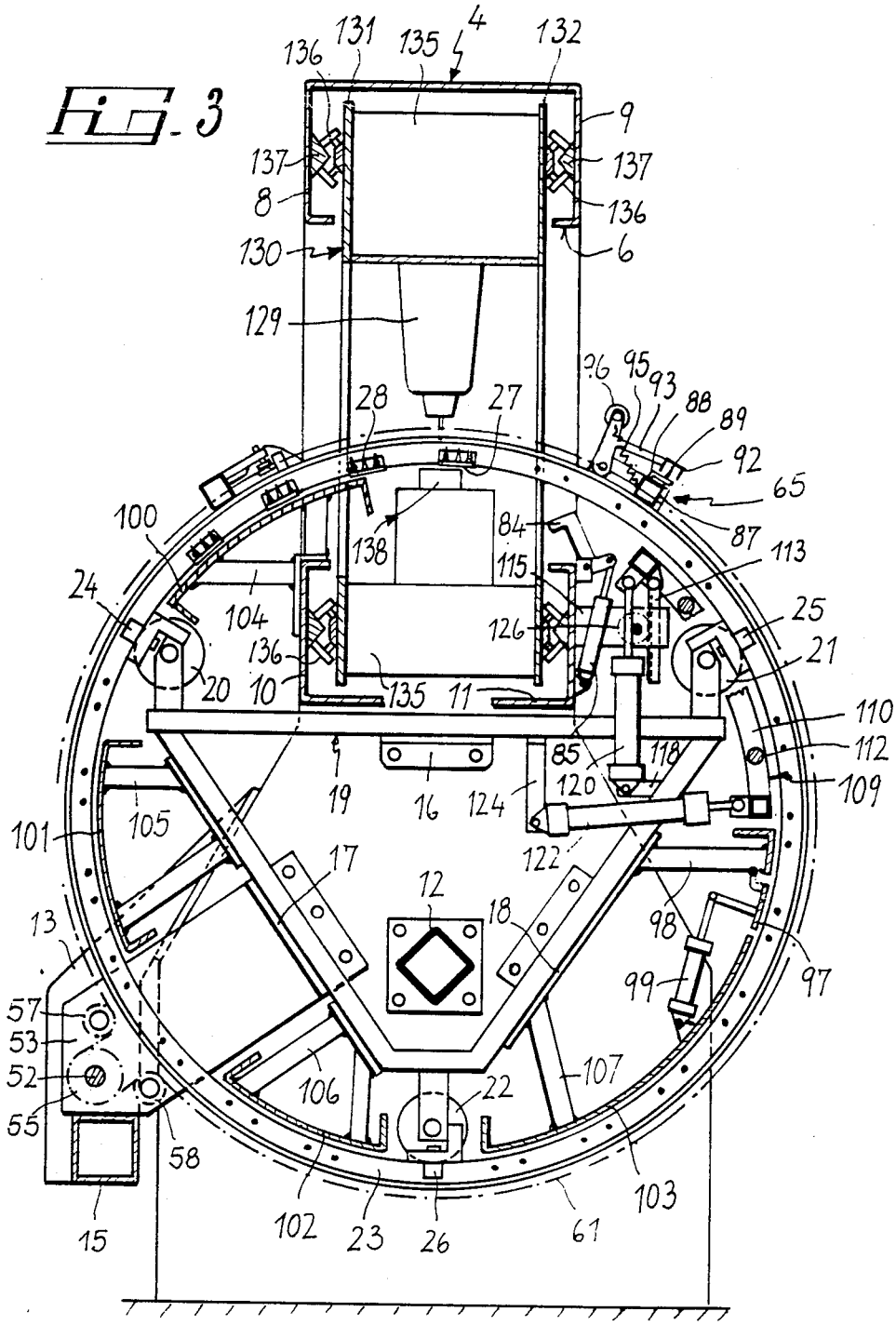
FIG. 3 is a view along the sectional plane III—III of FIG. 2.
Figure 4:
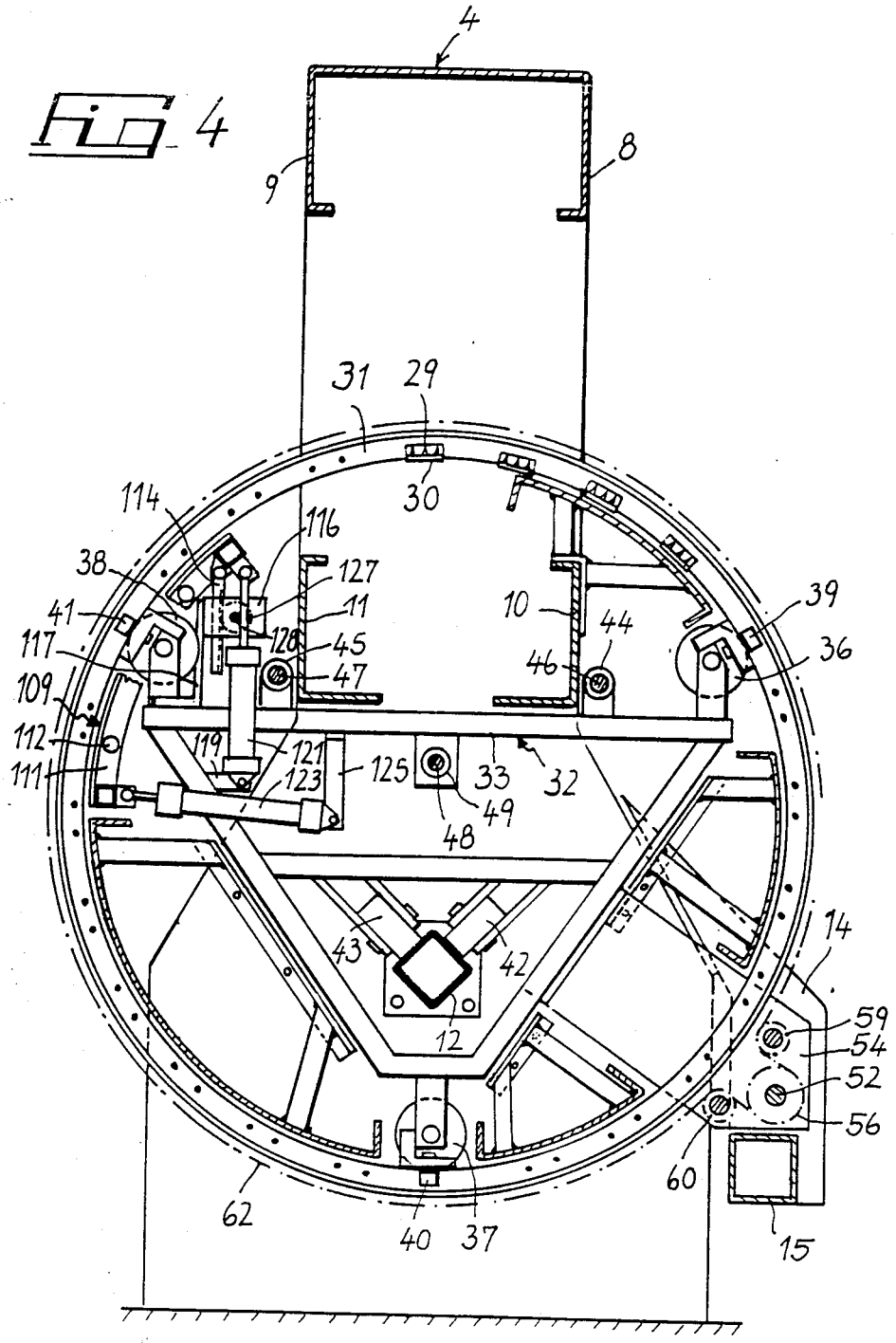
FIG. 4 is a view along the sectional plane IV—IV of FIG. 2.

The beams 4 and 5 are each composed of two members 8, 9 and respectively 10, 11 having counterposed C-shaped cross sections (FIGS. 2, 3, 4).

Between the columns 2 and 3, at the lower opening 7, there extends a horizontal beam 12 with square cross section with the faces inclined at 45° with respect to a vertical plane and provided, at the opposite ends, with flanges for fixing to the columns.

The portions of the columns 2 and 3, which delimit the lower opening 7 at the sides, widen towards the ground and two respective downwardly extending brackets 13, 14 are frontally rigidly associated therewith. The opposite ends of a tubular beam 15 with square cross section, parallel to the preceding beam 12, are welded to the brackets 13, 14.

Three angular elements 16, 17, 18 are rigidly associated with the column 2, on the face opposite the column 3 and below the members 10, 11. A frame 19, having the shape of an inverted triangle with the lower vertex underlying the beam 12, is fixed to the angular elements 16,17,18.

Figure 5:
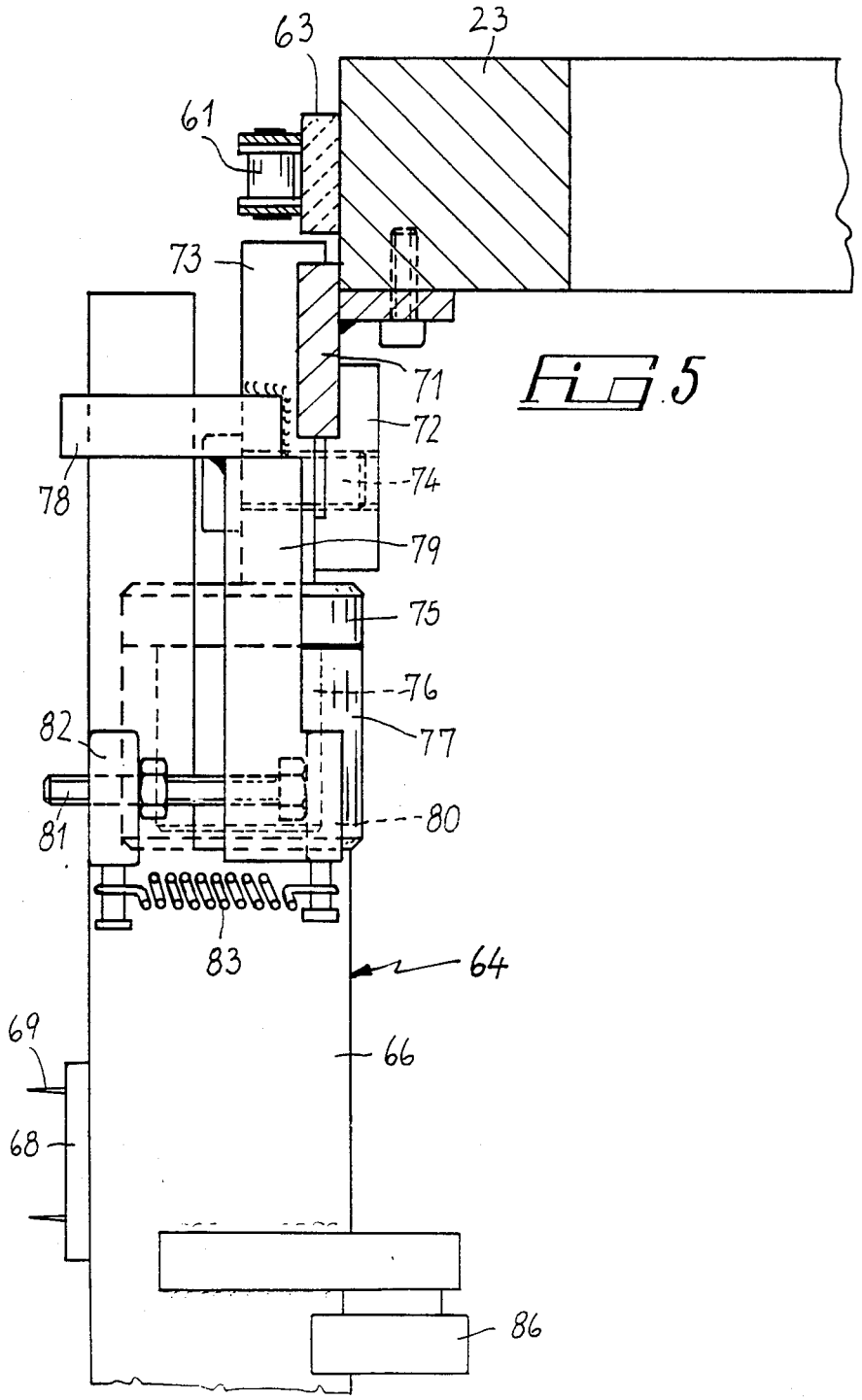
FIG. 5 is a view along the sectional plane V—V of FIG. 2.

Brackets are arranged at the vertices of the frame 19 for the rotatable support of three rollers 20, 21, 22. The rollers 20, 21, 22 are tangentially in contact with the inner surface of a hoop 23 with square cross section (see FIG. 5) which embraces the beam 5. The hoop 23 is therefore capable of rolling on the rollers 20, 21, 22. To prevent the derailment of the hoop, respective pairs of rollers 24, 25, 26 which roll on the opposite sides of the hoop are provided on the supporting brackets of the rollers 20–22. Small angularly distributed L-shaped elements 27 are rigidly associated on the inward face of the hoop, that is to say on the face opposite to the one directed towards the column 2, and bear needles 28 directed radially outwards or appropriate clamps, and act as hooking elements for an edge of the cloth to be quilted. The other edge of the cloth is hooked to the same number of needles 29 fixed to small L-shaped elements 30 which protrude from a second hoop 31 coaxial to the hoop 23 and rotatably coupled thereto. However the hoop 31 is capable of being moved with respect to the hoop 23 depending on the width of the cloth to be quilted. For this purpose the hoop 31 is mounted rotatable on a carriage 32 composed of two triangular frames 33, 34, similar to the frame 19, and connected to one another by crossbars 35.

The frame 34 carries at the vertices three free rollers 36, 37, 38 tangent internally to the hoop 31, to each whereof is coupled a pair of anti-derailment rollers 39, 40, 41 according to a construction identical to the one related to said rollers 24–26.

From the crossbars 35 protrude two brackets, converging internally to the frame 32, and which rotatably support two respective wheels 42, 43 having planes of rotation perpendicular to one another. The wheels 42, 43 roll on the upper faces of the beam 12, which thus constitutes a sort of sliding rail for the carriage 32.

Above the carriage 32 and laterally with respect to the members 10, 11, bushes 44, 45 are mounted wherein slide two guiding bars 46, 47 fixed to the sides of said members parallel to the beam 12. The bars 46, 47 have the purpose of preventing oscillations of the carriage 32 the weight whereof rests in any case on the beam 12.

The hoop 31 moves with respect to the hoop 23 by means of a threaded rod 48 which has an end axially rigidly associated but rotatable with respect to the column 3 below the beam 5.

The rod 48 is engaged in a female thread 49 rigidly associated with the carriage 32 and is actuated by a reversible motor reducer 50 installed below the beam 5.

For the motorization of the hoops 23 and 31 a single motor is provided, consisting of a reversible motor reducer 51 mounted centrally on the beam 15 and provided with an output shaft 52 the opposite ends whereof are supported in plates 53 and 54 rigidly associated with the angular element 17 and with the frame 34. The shaft 52 is telescoping to allow the mutual spacing and approach of the hoops 23 and 31.

On the shaft 52, at the planes of rotation of the hoops 23 and 31, respective pinions 55, 56 are keyed, whereon with the aid of pairs of free spools 57, 58 and 59, 60, protrudingly supported by the plates 53 and 54, there mesh two chains 61, 62 closed in a loop about said hoops.

Conveniently, on the outer surface of the hoops a strip 63 (see FIG. 5) is provided, in material having such characteristics as to keep the chain guided and allow the links of the chain to penetrate therein and ensure an effective traction action.

As illustrated above, while two lateral edges of the cloth to be quilted are hooked to the needles 28, 29 of the hoops 23, 31, for the fixing of the terminal and initial edges two needle-holder bars 64, 65 are provided which extend between the hoops 23 and 31, and each whereof is telescoping.

The needle-holder bar 64, which is the one which fastens the terminal edge of the cloth, is constituted by a tubular profiled element 66 with square cross section wherein slides a rod 67, also with square cross section, so as to cause a prismatic rotary coupling.

Evenly spaced L-shaped elements 68 are rigidly associated with the tubular profiled element 66 and orientated tangentially with respect to the hoops, each provided with a pair of needles 69. A plurality of clamps 70 can be provided on the rod 76, each having an L-shaped element 68 provided with a pair of needles 69. The clamps 70 are removable and adjustable on the rod 67 to allow its sliding in the profiled element 66 during the approach of the hoops. The coupling of the bar 64 to the hoops 23 and 31 is conceived so as to allow the rotation of said bar by a certain angle and to move the bar along the periphery of the hoops as a function of the length of the cloths to be quilted.

For this purpose, with the hoop 23 there is rigidly associated a ring 71 (FIG. 5) which protrudes inwards and on which a clamp is fixable, composed of two jaws 72, 73 locked to one another by a bolt 74.

The jaw 73 is rigidly associated with a disk 75 from which there extends a tang 76 engaged rotatably in a bush 77 welded in a recess provided on the head of the profiled element 66.

With the jaw 73 there is rigidly associated a small plate 78 from which there protrudes a small arm 79 which bears a flap 80 acting as abutment for a screw 81 screwed, in an adjustable manner, in a small column 82 fixed to the profiled element 66. Between the small column 82 and the flap 80 there acts a traction spring 83 which keeps the screw 81 resting against the flap 80. In this position the needles 69 are perpendicular to the plane of tangency of the hoops. Naturally the coupling of the rod 64 to the hoop 31 is fully identical to the one just described. The hoops 23 and 31 and the needle-holder bars 64 and 65 constitute what in the present description is defined as the cloth-holder cylinder.

The bar 64 oscillates in order to hook and unhook the needles 69 from the edge of the cloth. This operation is performed in a very precise angular stop position of the cylinder. The control is actuated by means of an L-shaped lever 84, articulated to the member 11 and controlled by an actuator constituted by a fluidodynamic jack 85. When the cylinder reaches the intended stop position, by actuating the jack 85, the lever 84 acts on a small roller 86 arranged on the profiled element 66, determining the rotation of the bar 64 in contrast with the return action of the springs 83 and, consequently, the lowering of the needles into the periphery of the cylinder.

Differently from the bar 64, the bar 65 for fixing the initial edge of the cloth does not rotate and extends telescopingly between the hoops 23 and 31. The bar 65 comprises therefore a tubular element 87 fixed to the hoop 23 and provided with small L-shaped elements 88 which bear pairs of needles 89. In the element 87 there is slideable a rod 90 fixed to the hoop 31, whereon needle-bearing clamps 91 are locatable. On the needles 89 there is superimposable a U-shaped profiled element 92, the opposite ends whereof are rigidly associated with respective levers 93, 94. The profiled element 92 is kept, by a spring 95, lowered on the needles so as to lock the edge of the cloth and at the same time provide a protection of the needles 89. To control the actuation in opening and in closure of the profiled element 92, a small roller 96 is provided on the lever 93; furthermore, a lever 97 acts on the small roller 96, the lever 97 being articulated to an arm 98 of the frame 1 and actuated by a jack 99.

To internally support the cloth stretched on the cylinder, a plurality of cylindrical sectors 100, 101, 102, 103 are fixed to stationary parts of the machine by means of arms 104, 105, 106, 107. More precisely, the sector 100 is fixed to the member 10, while the sectors 101, 102, 103 are fixed on one side to the frame 19 and, on the opposite side, to brackets rigidly associated with the inner face of the column 3. In FIG. 2 said sectors are not illustrated for the sake of clarity.

A grid 109 is arranged along the portion of circle comprised between the sectors 100 and 103, the grid 109 being in the shape of a cylindrical sector composed of two arcs 110, 111 connected to one another by telescoping rods. The grid 109 is movable radially outwards to push from the inside against the cloth and unhook it from the needles on which it is retained.

For this purpose, two stems 113, 114 are articulated to the opposite ends of the grid 109, proximate to the upper ends of the arcs 110, 111, and are vertically guided in a block 115 rigidly associated with the member 11 and respectively in a block 116 supported by an L-shaped element 117 to the carriage 32.

Between the upper ends of the arcs 110, 111 and the coupling points 118, 119 of the frame 19 and of the carriage 32, substantially vertical fluidodynamic jacks 120, 121 are arranged. Two similar jacks 122, 123 are arranged horizontally between the lower ends of the arcs 110, 111 and the couplings 124, 125 of the frame 19 and of the carriage 32. In this manner, by simultaneously actuating the jacks 120-123, the grid 109 moves along a radial component. To neutralize any unbalancing effects of the jacks the stems 113, 114 have a racklike structure for engaging spools 126, 127 mutually connected by a shaft 128.

For quilting the cloth stretched on the cylinder, a sewing head 129 is provided, linearly movable along a generatrix of the cylinder. The sewing head is supported by a slider 130 slideable between the members 8–11 and constituted by a pair of shoulders 131, 132 which have two horizontal portions 133, 134 superimposed, C-shaped and mutually connected by transverse stiffening ribs 135. On the shoulders 131, 132, pairs of rollers 136 are laterally mounted for the sliding of the slider on rails 137 fixed inside the members.

The upper portion 133 of the slider moves above the cloth stretched on the cylinder, while the lower portion 134 enters the hoop 23 and moves below the cloth. The sewing head 129 and the so-called "crochet" device 138 (FIG. 3), which cooperates with the sewing head for the execution of the stitches, are mounted at the ends of the portions 133, 134.

Parallel to the sliding direction of the slider, a chain 139 is fixed thereon, and a pinion 140 of a motor reducer 141 flanged on the column 2 meshes therewith. The actuation of the motor reducer 141 determines the movement of the slider 130 and therefore of the sewing head 129 with respect to the cloth.

The operation of the described apparatus is as follows.

The cloth to be quilted is initially applied to the cylinder by hooking the initial edge of the cloth on the needles 89 against which it is fixed by the bar 92. Then, by rotating the cylinder, the lateral edges of the cloth are hooked on the needles 28, 29. The final edge of the cloth is finally hooked to the needles 69 of the bar 64 and once the cloth is stretched and cut the quilting is executed.

By virtue of the linear motion of the sewing head by means of the actuation of the motor reducer 141 and of the rotation of the cylinder by means of the motor reducer 51 (which causes both hoops 23, 31 to rotate simultaneously), it is possible to perform sewings according to any trajectory. Advantageously the motor reducers 51 and 141 are controlled by a programmed processor.

Once the quilting is completed the cloth is removed by unhooking the perimetral flaps of the cloth first from the needles 69, by means of the rotation of the bar 6 as a consequence of the abutment of the lever 84 on the roller 86, then from the needles 28 and 29 and from the needles 89.

An advantage of the described machine resides in the possibility of its rapid adaptation to the dimensions of the cloths to be quilted. In fact, by activating the motor reducer 50, it is possible to move the carriage 32 on the guides 46 and vary the distance between the hoops 23 and 31, while by slackening the locking force of the jaws 72, 73 on the rings 71 it is possible to move the bar 64 with respect to the bar 65.

As can be seen, the invention substantially achieves the intended aim and objects. In particular the machine has an extended dimension in one direction and therefore has substantially reduced overall dimensions with respect to that of conventional machines with the cloth-holder carriage movable in two orthogonal directions.

We claim:

1. Quilting machine comprising a main frame including vertical columns, an upper horizontal beam, an intermediate horizontal beam and a lower horizontal beam, said beams connecting said vertical columns, said upper and intermediate beams defining an upper and a lower opening and said lower beam extending through said lower opening, a cloth-holder cylinder rotatably supported on said main frame and surrounding said intermediate and lower beam, said cylinder having a rotation axis parallel to said beam, means provided on said cylinder for fastening a cloth thereof according to a cylindrical surface, a C-shaped slider slidingly mounted on said upper and intermediate beams and having two parallel portions externally and internally extending with respect to said cylindrical surface, on said external portion being mounted a sewing head and on said internal portion being mounted a "crochet" device cooperating with said sewing head, meand being further provided for moving said slider along said upper and intermediate beams and for rotating said cylinder to cause said sewing head to follow a predetermined sewing line.

2. Quilting machine according to claim 1 wherein said clothholder cylinder comprises a further frame fixed to a vertical column of said main frame, a carriage slidingly supported on said lower beam, means for moving said carriage with respect to said further frame, a pair of hoops rotatably supported on said further frame and carriage respectively, a pair of telescopic bars axially connecting said hoops, said hoops and bars being provided with needle-holder elements for fastening the lateral, initial and terminal edges of the cloth to be quilted.

3. Quilting machine according to claim 2, wherein said means for moving said cylinder comprises a pair of chains each wound on the periphery of a respective hoop and meshing with respective pinions, said pinions being keyed to a telescopic shaft rotatably supported on said main frame and parallel to the rotation axis of said cylinder and actuated by a motor reduced.

4. Quilting machine according to claim 2 wherein said means for moving said carriage comprises a threaded rod parallel to the rotation axis of said cylinder and axially rigidly but rotatably supported on said main frame, said rod being in engagement with a female thread provided on said carriage and a reversible motor reducer being mounted on said main frame for actuating said rod and causing said carriage to move along said lower beam.

5. Quilting machine according to claim 2 further comprising a plurality of stationary cylindrical sectors axially extending inside said pair of hoops and circumferentially thereto for internally support the cloth to be quilted, one of said sectors being movable radially outwards to push the cloth out of engagement with the needles.

6. Quilting machine according to claim 2 wherein one of said telescopic bars is rotatably supported on said hoops to allow releasing of the needles from the cloth and adjustable along said hoops as a function of the length of the cloth to be quilted.

* * * * *